US010808666B2

(12) United States Patent
Kurt et al.

(10) Patent No.: US 10,808,666 B2
(45) Date of Patent: Oct. 20, 2020

(54) HIGH-PRESSURE FUEL PUMP AND FUEL SUPPLY DEVICE FOR AN INTERNAL COMBUSTION ENGINE, IN PARTICULAR OF A MOTOR VEHICLE

(71) Applicant: Continental Automotive GmbH, Hannover (DE)

(72) Inventors: Yavuz Kurt, Roding (DE); Michael Mauer, Regensburg (DE); Heiko Zabich, Regensburg (DE); Klaus Jeziorowski, Regensburg (DE)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 15/766,186

(22) PCT Filed: Sep. 20, 2016

(86) PCT No.: PCT/EP2016/072283
§ 371 (c)(1),
(2) Date: Apr. 5, 2018

(87) PCT Pub. No.: WO2017/060074
PCT Pub. Date: Apr. 13, 2017

(65) Prior Publication Data

US 2018/0283336 A1 Oct. 4, 2018

(30) Foreign Application Priority Data

Oct. 7, 2015 (DE) ..... 10 2015 219 415

(51) Int. Cl.
*F02M 59/44* (2006.01)
*F02M 69/04* (2006.01)
(Continued)

(52) U.S. Cl.
CPC ..... *F02M 59/44* (2013.01); *F02M 37/0017* (2013.01); *F02M 37/0047* (2013.01);
(Continued)

(58) Field of Classification Search
CPC ..... F02D 41/3094; F02D 2041/3881; F02M 37/0017; F02M 37/0047; F02M 53/00;
(Continued)

(56) References Cited

U.S. PATENT DOCUMENTS 6,446,612 B1 9/2002 Hankins et al.
6,739,317 B2 * 5/2004 Kellner ..... F02M 59/366 123/198 DB (Continued)

FOREIGN PATENT DOCUMENTS

DE 19647049 A1 5/1998
DE 102010016260 A1 10/2010

(Continued)

OTHER PUBLICATIONS

International Search Report and Written Opinion dated Dec. 12, 2016 from corresponding International Patent Application No. PCT/EP2016/072283.

(Continued)

*Primary Examiner* — John M Zaleskas

(57) ABSTRACT

The invention relates to a high-pressure fuel pump for supplying fuel to a first injection device of an internal combustion engine, in particular of a motor vehicle, having at least one first low-pressure port, via which the fuel can be fed to the high-pressure fuel pump from a low-pressure fuel pump for conveying the fuel, having at least one low-pressure chamber, to which at least a part of the fuel fed to the high-pressure fuel pump via the first low-pressure port can be fed, having at least one second low-pressure port, for conducting the fuel conveyed by means of the low-pressure (Continued)

fuel pump and fed to the high-pressure fuel pump away from the high-pressure fuel pump to a second injection device provided in addition to the first injection device.

6 Claims, 4 Drawing Sheets

(51) Int. Cl.

| | |
|---|---|
| ***F02M 37/00*** | (2006.01) |
| ***F02M 55/02*** | (2006.01) |
| ***F02M 59/02*** | (2006.01) |
| ***F02M 63/02*** | (2006.01) |
| ***F02M 55/00*** | (2006.01) |
| ***F02M 59/48*** | (2006.01) |
| *F02D 41/38* | (2006.01) |
| *F02D 41/30* | (2006.01) |

(52) U.S. Cl.
CPC ..... *F02M 55/004* (2013.01); *F02M 55/02* (2013.01); *F02M 59/025* (2013.01); *F02M 59/442* (2013.01); *F02M 59/48* (2013.01); *F02M 63/029* (2013.01); *F02M 63/0265* (2013.01); *F02M 63/0285* (2013.01); *F02M 69/046* (2013.01); *F02D 41/3094* (2013.01); *F02D 2041/3881* (2013.01)

(58) Field of Classification Search
CPC ..... F02M 55/004; F02M 55/04; F02M 55/02; F02M 59/102; F02M 59/44; F02M 59/442; F02M 63/0001; F02M 63/0225; F02M 63/0265; F02M 63/0285; F02M 63/029; F02M 69/02; F02M 69/046
See application file for complete search history.

(56) References Cited

U.S. PATENT DOCUMENTS

2005/0098155 A1* 5/2005 Yamazaki ..... F02D 41/3094 123/431
2006/0075992 A1 4/2006 Akita et al.
2006/0159555 A1* 7/2006 Inoue ..... F04B 1/0408 417/297
2008/0115766 A1 5/2008 Ricco et al.
2008/0289713 A1* 11/2008 Munakata ..... F02M 55/04 138/26
2009/0288639 A1* 11/2009 Usui ..... F02M 55/04 123/457
2010/0101538 A1* 4/2010 Beardmore ..... F02M 59/102 123/495
2011/0097228 A1* 4/2011 Tokuo ..... F02M 37/0047 417/505
2012/0004084 A1 1/2012 Neubauer
2012/0279474 A1* 11/2012 Hoefner ..... F02M 37/0047 123/448
2012/0312278 A1* 12/2012 Usui ..... F02M 59/462 123/446
2013/0098338 A1* 4/2013 Usui ..... F02M 69/02 123/495
2013/0118449 A1* 5/2013 Marriott ..... F02M 43/02 123/304
2014/0216418 A1* 8/2014 Asayama ..... F02M 59/44 123/495
2014/0224209 A1* 8/2014 Pursifull ..... F02M 63/0001 123/294
2014/0224217 A1* 8/2014 Pursifull ..... F02M 39/005 123/446
2015/0132166 A1* 5/2015 Ukai ..... F02M 63/0265 417/437
2015/0285166 A1* 10/2015 Surnilla ..... F02D 33/003 123/294
2015/0337753 A1* 11/2015 Stickler ..... F02M 57/02 123/506
2015/0354491 A1* 12/2015 Ulrey ..... F02D 41/123 123/294
2016/0131097 A1* 5/2016 Matsuo ..... F02M 59/025 123/495
2016/0153385 A1* 6/2016 Pursifull ..... F02D 41/3845 123/299
2016/0169144 A1* 6/2016 Surnilla ..... F02D 41/3845 123/435
2016/0169145 A1* 6/2016 Surnilla ..... F02D 41/345 701/104
2016/0208757 A1* 7/2016 Pursifull ..... F02M 59/022
2016/0208758 A1 7/2016 Nigrin et al.
2016/0245218 A1* 8/2016 Ulrey ..... F02M 59/022
2016/0363104 A1* 12/2016 Sanborn ..... F02M 37/0041
2016/0377015 A1* 12/2016 Pursifull ..... F02M 55/025 701/103
2016/0377016 A1* 12/2016 Ulrey ..... F02D 41/3845 701/103
2016/0377017 A1* 12/2016 Basmaji ..... F02D 41/3845 701/103
2016/0377018 A1* 12/2016 Sanborn ..... F02M 63/0285 123/457
2017/0167450 A1* 6/2017 Spakowski ..... F02M 31/20
2017/0204803 A1* 7/2017 Pursifull ..... F02D 41/3845
2017/0284353 A1* 10/2017 Nozu ..... F02M 39/02
2017/0292485 A1* 10/2017 Nah ..... F02M 55/02
2017/0306880 A1* 10/2017 Nakaoka ..... F02D 41/3836
2018/0223786 A1* 8/2018 Kurt ..... F02M 63/0001
2018/0298858 A1* 10/2018 Kurt ..... F02M 63/029

FOREIGN PATENT DOCUMENTS

| | | | |
|---|---|---|---|
| DE | 102010026159 | A1 | 1/2012 |
| EP | 1550805 | A1 | 7/2005 |
| EP | 2591225 | A1 | 5/2013 |
| GB | 2038975 | A | 7/1980 |
| JP | H0295170 | A | 4/1990 |
| JP | H0687662 | U | 12/1994 |
| JP | 2004340208 | A | 12/2004 |
| JP | 2006132517 | A | 5/2006 |
| JP | 2006138309 | A | 6/2006 |
| JP | 2007032546 | A | 2/2007 |
| JP | 2009007986 | A | 1/2009 |
| JP | 2012026358 | A | 2/2012 |
| JP | 2012122437 | A | 6/2012 |
| JP | 2012127290 | A | 7/2012 |
| JP | 2012163111 | A | 8/2012 |
| JP | 5401360 | B2 | 1/2014 |
| JP | 2015098849 | A | 5/2015 |
| JP | 2016109027 | A | 6/2016 |
| KR | 20140106765 | A | 9/2014 |
| WO | 2012004084 | A1 | 1/2012 |
| WO | 2013035131 | A1 | 3/2013 |
| WO | 2014184628 | A1 | 11/2014 |

OTHER PUBLICATIONS

Office Action dated Sep. 9, 2016 from corresponding German Patent Application No. 10 2015 219 415.9.
File History for U.S. Appl. No. 15/766,403, including Office Action dated Jun. 26, 2019.
File History for U.S. Appl. No. 15/945,115, including Office Action dated Jun. 28, 2019.
Korean Office Action dated May 30, 2019 for counterpart Korean patent application 10-2018-7012205.
China Patent Office Action, dated Sep. 2, 2019, for counterpart CN application 201680059296.1.
Notice of Allowance, dated Sep. 10, 2019, for counterpart JP patent application 2018-518453.
Japan Office Action, dated May 8, 2019, for counterpart JP patent application 2018-518453.

(56) References Cited

OTHER PUBLICATIONS

Indian Office Action dated Feb. 10, 2020 for the counterpart Indian Patent Application 201817007494.

* cited by examiner

HIGH-PRESSURE FUEL PUMP AND FUEL SUPPLY DEVICE FOR AN INTERNAL COMBUSTION ENGINE, IN PARTICULAR OF A MOTOR VEHICLE

BACKGROUND

The invention relates to a high-pressure fuel pump for an internal combustion engine, as per the preamble of patent claim 1, and to a fuel supply device.

A high-pressure fuel pump of said type, and a fuel supply device of said type for an internal combustion engine, in particular of a motor vehicle, already emerge, so as to be known, for example from US 2012/0312278 A1. The fuel supply device serves for supplying fuel, in particular liquid fuel, to the internal combustion engine. The fuel supply device comprises a first injection device for effecting a direct injection of fuel. This means that the internal combustion engine has at least one combustion chamber into which the fuel can be directly injected by means of the first injection device.

The fuel supply device furthermore comprises a second injection device, which is provided in addition to the first injection device, for effecting an induction pipe injection of fuel. During the course of the induction pipe injection of fuel, which is also referred to as induction pipe injection, the fuel is introduced, in particular injected, into the internal combustion engine at a location arranged upstream of the combustion chamber. Said location is arranged for example in an induction pipe, through which air can flow, of the internal combustion engine, and upstream of an inlet valve of the internal combustion engine.

The fuel supply device furthermore comprises the above-mentioned high-pressure fuel pump, by means of which the fuel can be supplied to the first injection device. The fuel supply device furthermore comprises a low-pressure fuel pump for conveying the fuel to the high-pressure fuel pump. By means of the low-pressure fuel pump, the fuel is conveyed for example at a first pressure. In other words, by means of the low-pressure fuel pump, a first pressure of the fuel that is conveyed by means of the low-pressure fuel pump is effected.

By means of the high-pressure fuel pump, the fuel is conveyed for example at a second pressure that is higher than the first pressure. In other words, by means of the high-pressure fuel pump, a second pressure of the fuel that is higher than the first pressure is effected. In this way, it is for example possible for the first injection device to be supplied with the second pressure that is higher than the first pressure, wherein the second injection device can be supplied with the first pressure.

The high-pressure fuel pump has at least one first low-pressure port via which the fuel can be fed to the high-pressure fuel pump from the low-pressure fuel pump. In other words, the fuel conveyed by means of the low-pressure fuel pump is fed via the first low-pressure port to the high-pressure fuel pump.

The high-pressure fuel pump furthermore has at least one second low-pressure port for conducting the fuel conveyed by means of the low-pressure fuel pump away from the high-pressure fuel pump to the second injection device. This means that the fuel conveyed by means of the low-pressure fuel pump is conducted to the high-pressure fuel pump, and in particular fed to the high-pressure fuel pump, via the first low-pressure port, wherein the fuel conveyed by means of the low-pressure fuel pump and fed via the first low-pressure port to the high-pressure fuel pump is conveyed via the second low-pressure port away from the high-pressure fuel pump and in the direction of or to the second injection device.

The high-pressure fuel pump furthermore comprises a pump housing. The high-pressure fuel pump furthermore comprises at least one conveying element, which is arranged at least partially in the pump housing and which is movable relative to the pump housing, for conveying the fuel from the high-pressure fuel pump to the first injection device. The conveying element is formed for example as a piston which is movable in translational fashion relative to the pump housing.

The high-pressure fuel pump furthermore has a compression chamber, the volume of which is variable by movement of the conveying element. The compression chamber is for example arranged in the pump housing. By means of the conveying element, the fuel in the compression chamber is compressed or pressurized.

Furthermore, the high-pressure fuel pump comprises at least one low-pressure chamber to which at least a part of the fuel fed to the high-pressure fuel pump via the first low-pressure port can be fed. In other words, at least a part of the fuel flowing through the first low-pressure port can flow into the low-pressure chamber.

Furthermore, the high-pressure fuel pump has a collecting chamber which is arranged on a side of the conveying element averted from the compression chamber and which is variable in terms of its volume by movement of the conveying element and which serves for collecting fuel from the compression chamber. Owing to leakages, for example, fuel can flow from the compression chamber into the collecting chamber and is collected by means of the collecting chamber, the volume of which is variable by movement of the conveying element. Here, the collecting chamber is fluidically connected to the low-pressure chamber.

Furthermore, WO 2012/004084 A1 discloses a fuel system for an internal combustion engine, having a low-pressure conveying device which conveys at least indirectly to at least one low-pressure injection device. The fuel system furthermore comprises a high-pressure conveying device for the fuel, which high-pressure conveying device has a drive region and a conveying region and conveys at least indirectly to at least one high-pressure injection device. It is provided here that the fuel is conveyed from the low-pressure conveying device firstly into the drive region of the high-pressure conveying device and from there onward to the low-pressure injection device and/or to the conveying region of the high-pressure conveying device.

It is an object of the present invention to further develop a high-pressure fuel pump and a fuel supply device of the type mentioned in the introduction such that a particularly advantageous supply of fuel to the internal combustion engine can be realized.

BRIEF SUMMARY

Said object is achieved by means of a high-pressure fuel pump having the features of patent claim 1 and also by means of a fuel supply device. Advantageous embodiments with expedient refinements of the invention are specified in the further claims.

To further develop a high-pressure fuel pump of the type specified in the preamble of patent claim 1 such that a particularly advantageous supply of fuel, in particular liquid fuel, to the internal combustion engine can be realized, it is provided according to the invention that, in particular as the fuel is being conveyed by means of the low-pressure fuel pump and/or by means of the high-pressure fuel pump, at least a part of the fuel flowing through the first low-pressure port flows from the first low-pressure port to the second low-pressure port, circumventing the collecting chamber, and flows through the second. The circumventing is also referred to as bypassing, such that at least the part of the fuel flows from the first low-pressure port to the second low-pressure port and, in so doing, bypasses the collecting chamber.

The circumventing or the bypassing is to be understood to mean that at least the part of the fuel flows from the first low-pressure port to the second low-pressure port but, in the process, does not flow through the collecting chamber, at least the part rather flowing past the collecting chamber from the first low-pressure port to the second low-pressure port. It is preferably provided that at least a predominant part of the fuel flowing from the first low-pressure port to the second low-pressure port circumvents the collecting chamber. The fuel flowing from the first low-pressure port to the second low-pressure port and in the process circumventing the collecting chamber flows for example through the low-pressure chamber.

In an advantageous embodiment of the invention, the pump housing is a first structural element of the high-pressure fuel pump, wherein the high-pressure fuel pump comprises a second structural element formed separately from the pump housing and held on the pump housing, which second structural element is formed for example as a cover of the high-pressure fuel pump. Here, both low-pressure ports are arranged on one of the structural elements. In this way, a particularly advantageous supply of the fuel, in particular liquid fuel, to the internal combustion engine can be realized, because it can be achieved that the fuel is guided through the high-pressure fuel pump in an expedient manner in terms of flow. In other words, the fuel conveyed from the low-pressure fuel pump can flow in a particularly expedient manner through the high-pressure fuel pump, that is to say from the first low-pressure port to the second low-pressure port and onward to the second injection device.

In a further advantageous embodiment of the invention, the low-pressure ports are fluidically connected to one another by means of a connecting region, wherein the connecting region is arranged within one of the structural elements. The structural space requirement of the high-pressure fuel pump can thereby be kept small. It is alternatively conceivable for the connecting region to be arranged outside the structural elements, whereby it can be achieved that the flow of the fuel is conducted in an expedient manner. By means of the arrangement of the connecting region within one of the structural elements, it is for example possible for a path along which the fuel flows from the first low-pressure port to the second low-pressure port and onward to the second injection device to be kept particularly short, whereby it is possible in particular to realize an advantageous supply of the fuel to the internal combustion engine.

A further embodiment is characterized in that at least one flow-dividing element is provided by means of which the fuel flowing through the first low-pressure port can be divided into a first partial stream and a second partial stream. Here, at least one of the partial streams flows from the first low-pressure port to the second low-pressure port, circumventing the collecting chamber, and flows through the second low-pressure port. In this way, the fuel conveyed from the low-pressure fuel pump can be supplied to the internal combustion engine, in particular the second injection device, over an at least substantially direct path or over a particularly short path.

It has proven to be particularly advantageous here if the first partial stream flows from the first low-pressure port to the second low-pressure port, circumventing the collecting chamber, and flows through said second low-pressure port, wherein the second partial stream flows from the first low-pressure port into the collecting chamber, through the collecting chamber and subsequently to the second low-pressure port, and flows through said second low-pressure port. Firstly, in this way, the first partial stream can be supplied to the internal combustion engine, in particular the second injection device, in a particularly advantageous manner. By means of the second partial stream, particularly effective and efficient cooling of the high-pressure fuel pump can be realized, such that overheating of the high-pressure fuel pump can be avoided. In this way, the supply of fuel to the internal combustion engine can be ensured, because the risk of a failure of the high-pressure fuel pump can be kept particularly low.

In a further embodiment of the invention, the flow-dividing element is arranged at least partially outside the structural elements and is designed to divide the fuel into the partial streams at at least one location arranged outside the structural elements. This means that the fuel is divided already upstream of the structural elements, such that, firstly, an effective supply of the fuel to the internal combustion engine and, secondly, effective cooling of the high-pressure fuel pump can be realized. Altogether, it is thus possible to ensure an advantageous supply of the fuel to the internal combustion engine.

A further embodiment is distinguished by the fact that the first low-pressure port and/or the second low-pressure port is formed in one piece with the single structural element on which both low-pressure ports are arranged. In this way, the number of parts and thus the costs of the high-pressure fuel pump can be kept low. Furthermore, it is possible to ensure an advantageous supply of fuel to the internal combustion engine.

In a further embodiment of the invention, it is provided that the first low-pressure port and/or the second low-pressure port is formed by a component which is formed separately from one structural element and which is arranged on said one structural element. Simple and inexpensive production and assembly of the high-pressure fuel pump can be realized in this way. Furthermore, the fuel can be conducted in a particularly expedient manner in terms of flow.

To keep the number of parts of the high-pressure fuel pump particularly low and to conduct the fuel in an expedient manner in terms of flow, in particular through the high-pressure fuel pump, it is provided in a further embodiment of the invention that the low-pressure ports are formed in one piece with one another.

In a further embodiment, it is provided that the low-pressure ports are formed by components which are formed separately from one another and which are at least indirectly, in particular directly, connected to one another, whereby it can be achieved that the fuel is conducted in a particularly advantageous and expedient manner in terms of flow, in particular through the high-pressure fuel pump.

Finally, it has proven to be particularly advantageous if the low-pressure ports can be flowed through by the fuel along a respective flow direction, wherein the flow directions run parallel or obliquely with respect to one another. In this way, an overly intense diversion of the fuel, in particular of the flow thereof, can be avoided, such that flow losses are kept particularly low.

To further develop a fuel supply device such that a particularly advantageous supply of the fuel to the internal combustion engine can be realized, it is provided according to the invention that at least a part of the fuel flowing through the first low-pressure port flows from the first low-pressure port to the second low-pressure port, circumventing the collecting chamber, and flows through said second low-pressure port. Advantages and advantageous embodiments of the high-pressure fuel pump according to the invention are to be regarded as advantages and advantageous embodiments of the fuel supply device according to the invention, and vice versa.

It is preferably provided here that the high-pressure fuel pump of the fuel supply device according to the invention is a high-pressure fuel pump according to the invention.

The invention also includes a vehicle, in particular a motor vehicle, such as for example a passenger motor vehicle, wherein the vehicle has at least one high-pressure fuel pump according to the invention and/or at least one fuel supply device according to the invention. Advantages and advantageous embodiments of the high-pressure fuel pump according to the invention and of the fuel supply device according to the invention are to be regarded as advantages and advantageous embodiments of the vehicle according to the invention, and vice versa.

Further advantages, features and details of the invention will emerge from the following description of preferred exemplary embodiments and from the drawing. The features and combinations of features mentioned in the description above and the features and combinations of features mentioned in the description of the figures below and/or shown in the figures alone may be used not only in the respectively stated combination, but also in a combination and/or individually, without departing from the scope of the invention.

DETAILED DESCRIPTION

In the figures, identical or functionally identical elements are provided with identical reference signs.

Figure 1:
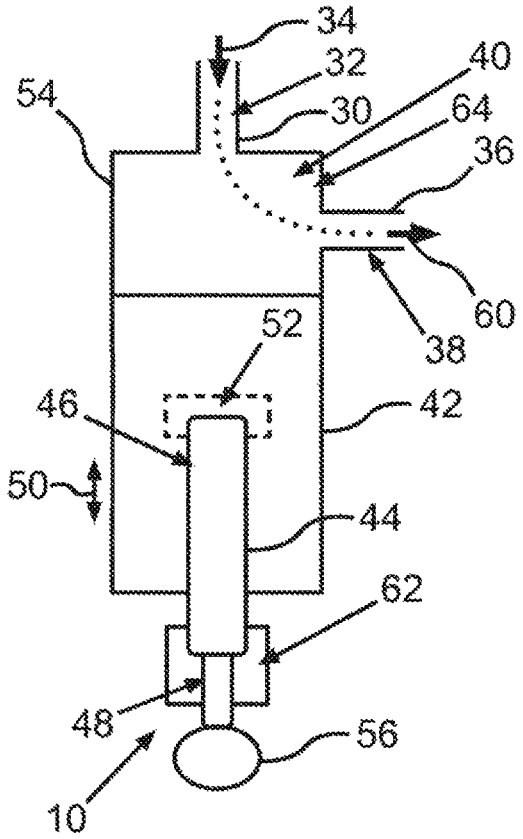
FIG. 1 shows a schematic sectional view of a high-pressure fuel pump according to a first embodiment for an internal combustion engine, wherein at least a part of a fuel flowing through a first low-pressure port of the high-pressure fuel pump flows from the first low-pressure port to a second low-pressure port of the high-pressure fuel pump, circumventing a collecting chamber, and flows through the second low-pressure port.

FIG. 1 shows, in a schematic sectional view, a high-pressure fuel pump according to a first embodiment, which is denoted as a whole by 10. Considering said figure together with FIG. 8, it can be seen that the high-pressure fuel pump 10 is a constituent part of a fuel supply device denoted as a whole by 12, by means of which fuel, in particular liquid fuel, can be or is supplied to an internal combustion engine. The fuel may for example be diesel fuel or gasoline. The internal combustion engine serves for example for the drive of a motor vehicle, in particular of a passenger motor vehicle, wherein the internal combustion engine may be formed as a reciprocating-piston internal combustion engine.

The internal combustion engine has a multiplicity of combustion chambers in the form of cylinders, wherein the fuel is fed to the combustion chambers. Furthermore, air is fed to the combustion chambers, such that a fuel-air mixture is formed in the respective combustion chamber from the air and the fuel. The fuel-air mixture is burned, resulting in exhaust gas of the internal combustion engine.

The respective combustion chamber is assigned at least one outlet duct via which the exhaust gas can be discharged from the combustion chamber. The outlet duct is assigned at least one gas exchange valve in the form of an outlet valve, wherein the outlet valve is movable between a closed position and at least one open position. In the closed position, the outlet duct is fluidically shut off by means of the outlet valve, such that the exhaust gas cannot flow from the combustion chamber into the outlet duct. In the open position, the outlet valve opens up the outlet duct, such that the exhaust gas can flow from the combustion chamber into the outlet duct.

Furthermore, the respective combustion chamber is assigned at least one inlet duct, via which the air can be fed to the combustion chamber. Here, the inlet duct is assigned at least one gas exchange valve in the form of an inlet valve, which is adjustable between a closed position and at least one open position. In the closed position, the inlet duct is fluidically shut off by means of the inlet valve, such that the air cannot flow from the inlet duct into the combustion chamber. In the open position, the inlet valve opens up the inlet duct, such that the air can flow through the inlet duct and can flow from the inlet duct into the combustion chamber.

The fuel supply device 12 comprises a first injection device 14, which is formed for example as a high-pressure injection device. Here, each combustion chamber is assigned an injection valve 16 of the first injection device 14. The first injection device 14 is in this case designed for effecting a direct injection of fuel, wherein the direct injection of fuel is also referred to as direct injection. During the course of the direct injection, the fuel is injected by means of the respective injection valve 16 directly into the respective combustion chamber, in particular cylinder. Here, the first injection device 14 comprises a fuel distribution element 18 which is common to the injection valves 16 and via which the fuel can be supplied to the injection valves 16. The fuel distribution element 18 is also referred to as rail, wherein the fuel distribution element 18 is referred to as high-pressure rail if the first injection device 14 is formed as a high-pressure injection device. By means of the first injection device 14, the fuel is injected for example at a first pressure into the combustion chambers, wherein, for example, the fuel at said first pressure can be accommodated in the fuel distribution element 18 and fed at the first pressure to the injection valves 16.

The fuel supply device 12 furthermore comprises a second injection device 20 which is provided in addition to the first injection device 14 and which is formed for example as a low-pressure injection device. The second injection device 20 is in this case designed for effecting an induction pipe injection of fuel, wherein the induction pipe injection of fuel is also referred to as induction pipe injection. Here, each combustion chamber is assigned at least one injection valve 22 of the second injection device 20.

The air is fed to the combustion chambers for example via an intake tract of the internal combustion engine, such that the intake tract can be flowed through by the air. The intake tract comprises for example an induction pipe, which is also referred to as induction module, intake module or air distributor. The intake tract may furthermore comprise the inlet ducts.

In the case of the induction pipe injection, the fuel is introduced, in particular injected, into the internal combustion engine, in particular into the intake tract, by means of the respective injection valve 22 at a location arranged upstream of the respective combustion chamber. In other words, the location at which the fuel is injected by means of the respective injection valve 22 is arranged upstream of the combustion chamber and in particular in the intake tract. Said location may be arranged for example in the induction pipe or in the inlet duct. In particular, the respective location at which the fuel can be injected by means of the respective injection valve 22 is arranged upstream of the respective inlet valve.

The second injection device 20 also comprises a fuel distribution element 24 which is common to the injection valves 22 and via which the fuel can be supplied to the injection valves 22. Here, the fuel distribution element 24 is also referred to as rail. Since the second injection device 20 is formed for example as a low-pressure injection device, the fuel distribution element 24 is also referred to as low-pressure rail. By means of the second injection device 20, the fuel can be injected for example at a second pressure that is lower than the first pressure. Here, the fuel at the second pressure may for example be accommodated or stored in the fuel distribution element 24 and fed at the second pressure to the injection valves 22. The fuel supply device 12 furthermore comprises a tank 26 in which the in particular liquid fuel can be accommodated.

Figure 8:
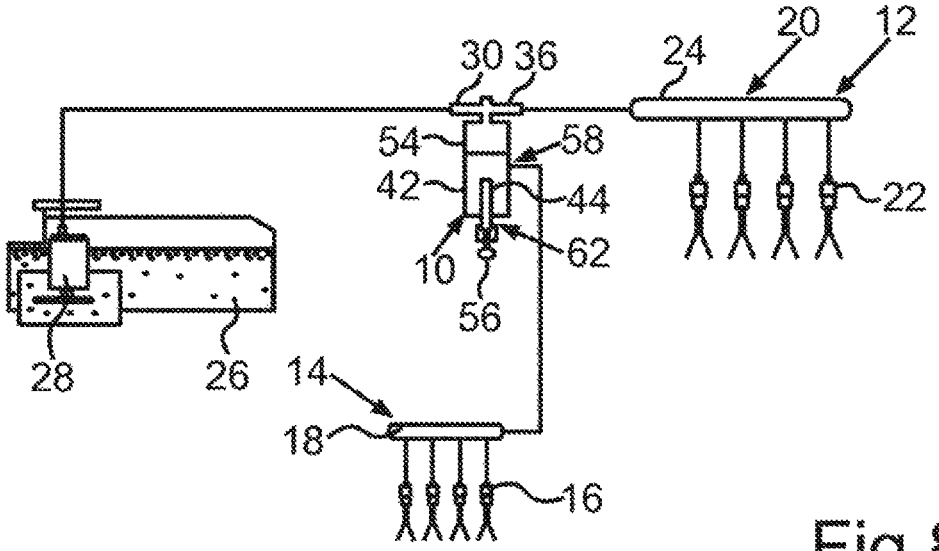
FIG. 8 is a schematic illustration of a fuel supply device for supplying fuel to an internal combustion engine of a motor vehicle, wherein the fuel supply device comprises the high-pressure fuel pump according to the first embodiment.

It can be seen from FIG. 8 that the high-pressure fuel pump 10 serves for the supply of the fuel to the first injection device 14. In other words, the fuel is supplied to the first injection device 14 by means of the high-pressure fuel pump 10, wherein the fuel is compressed or pressurized for example by means of the high-pressure fuel pump 10 such that the stated first pressure of the fuel can be or is effected for example by means of the high-pressure fuel pump 10. In other words, the fuel is conveyed at the first pressure to the first injection device 14 by means of the high-pressure fuel pump 10.

The fuel supply device 12 furthermore comprises a low-pressure fuel pump 28 which is provided in addition to the high-pressure fuel pump 10 and which serves for conveying the fuel from the tank 26 to the high-pressure fuel pump 10. In other words, the fuel is conveyed from the tank 26 to the high-pressure fuel pump 10 by means of the low-pressure fuel pump 28. For example, the fuel is conveyed at a third pressure by means of the low-pressure fuel pump 28. This means that a third pressure of the fuel is effected for example by means of the low-pressure fuel pump 28, wherein the fuel is conveyed at the third pressure to the high-pressure fuel pump 10 by means of the low-pressure fuel pump 28. Here, the third pressure may correspond to the second pressure, such that, for example, the second pressure of the fuel can be effected by means of the low-pressure fuel pump. In other words, the low-pressure fuel pump 28 can for example convey the fuel at the second pressure.

It can be seen from FIGS. 1 and 8 that the high-pressure fuel pump 10 has a first low-pressure port 30 which comprises a first duct 32 which can be flowed through by the fuel. Via the first low-pressure port 30, the high-pressure fuel pump 10 is fluidically connected to the low-pressure fuel pump 28, such that the fuel conveyed by means of the low-pressure fuel pump 28 can be or is fed, in particular at the second or third pressure, from the low-pressure fuel pump 28 to the high-pressure fuel pump 10 via the first low-pressure port 30, in particular via the first duct 32. This feed is illustrated in FIG. 1 by means of a directional arrow 34. Since the fuel is fed via the first low-pressure port 30 or via the first duct 32 to the high-pressure fuel pump 10, the first low-pressure port 30 is also referred to as inflow.

The high-pressure fuel pump 10 furthermore comprises at least one second low-pressure port 36, which has a second duct 38 which can be flowed through by the fuel. The second low-pressure port 36 or the second duct 38 serves for conducting the fuel conveyed by means of the low-pressure fuel pump 28 and fed to the high-pressure fuel pump 10 via the inflow (first low-pressure port 30), in particular at the second or third pressure, away from the high-pressure fuel pump to the second injection device 20, in particular to the fuel distribution element 24, such that the fuel can be accommodated or stored at the second or third pressure in the fuel distribution element 24.

It can be seen from FIG. 8 that the second injection device 20, in particular the fuel distribution element 24, is fluidically connected to the high-pressure fuel pump 10 via the second low-pressure port 36, such that the fuel that is initially fed to the high-pressure fuel pump 10 via the inflow can be fed or is fed via the second low-pressure port 36 to the fuel distribution element 24. Thus, the fuel at the third pressure or second pressure flows through the first low-pressure port 30 or the first duct 32. In other words, the fuel in the first low-pressure port or in the first duct 32 is for example at the third pressure effected by means of the low-pressure fuel pump 28, which may correspond to the second pressure. Furthermore, the fuel at the second pressure flows through the second low-pressure port 36 or the second duct 38. In other words, the fuel in the second low-pressure port 36 or in the second duct 38 is at the second pressure.

The high-pressure fuel pump 10 has a low-pressure chamber 40 which can be flowed through by at least a part of the fuel fed to the high-pressure fuel pump 10 via the inflow (first low-pressure port 30).

The high-pressure fuel pump 10 furthermore comprises a first structural element in the form of a pump housing 42. Furthermore, the high-pressure fuel pump 10 comprises a conveying element for conveying at least a part of the fuel fed to the high-pressure fuel pump 10 via the inflow, wherein said conveying element is in the present case formed as a piston 44. The piston 44 is also referred to as conveying piston, wherein the piston 44 in the present case has a first length region 46 and an adjoining second length region 48. The length region 46 has a first outer circumference, wherein the length region 48 has a second outer circumference which is shorter than the first outer circumference. The length regions 46 and 48 are preferably formed in one piece with one another. Since the length regions have different outer circumferences, the piston 44 has a step. The piston 44 is thus formed as a stepped pin.

It is alternatively conceivable for the length regions 46 and 48 to have the same outer circumference, such that the piston 44 has no step.

The piston 44 is arranged at least partially in the pump housing 42, and in this case is movable relative to the pump housing 42, wherein the piston 44 is in the present case movable in translational fashion relative to the pump housing 42. Said translational mobility of the piston 44 relative to the pump housing 42 is indicated in FIG. 1 by a double arrow 50. On a first side of the piston 44, a compression chamber 52, illustrated in particularly schematic form in FIG. 1, of the high-pressure fuel pump 10 is depicted, wherein the compression chamber 52 is arranged for example in the pump housing 42. A volume of the compression chamber 52 can be varied by translational movement of the piston 44 relative to the pump housing 42 and thus relative to the compression chamber 52.

The high-pressure fuel pump 10 furthermore comprises a second structural element in the form of a cover 54, which is formed separately from the pump housing 42 and which is connected to the pump housing 42 or held on the pump housing 42.

Furthermore, a drive element is provided in the form of a cam 56 which is illustrated particularly schematically in FIG. 1 and by means of which the piston 44 is movable relative to the pump housing 42, in the present case in the direction of the cover 54. Here, the high-pressure fuel pump 10 comprises at least one spring element which is not illustrated in FIG. 1 and which is placed under stress by movement of the piston 44 in the direction of the cover 54. By means of the spring element, the piston 44 is moved from the cover 54 back in the direction of the cam 56 and is in particular held in supported contact with the cam 56 by relaxation of the spring element. Movement of the piston 44 in the direction of the cover 54 causes the volume of the compression chamber 52 to be decreased, whereby the fuel accommodated in the compression chamber 52 is compressed, that is to say pressurized.

Movement of the piston 44 away from the cover 54 causes the volume of the compression chamber 52 to be increased, whereby fuel is drawn into the compression chamber 52. Here, it is provided in particular that the compression chamber 52 is fluidically connectable or connected to the low-pressure chamber 40, such that fuel can be or is drawn into the compression chamber 52 from the low-pressure chamber 40 by means of the piston 44.

The fuel that is drawn and thus flows from the low-pressure chamber 40 into the compression chamber 52 is at least a part of the fuel fed via the inflow to the high-pressure fuel pump 10, because at least a part of the fuel fed via the inflow to the high-pressure fuel pump 10 can flow into the low-pressure chamber 40 and be drawn from there into the compression chamber 52 by means of the piston 44.

As a result of the compression of the fuel, a fourth pressure of the fuel can be effected or set by means of the high-pressure fuel pump 10, wherein the fourth pressure is higher than the second and the third pressure. For example, the fourth pressure corresponds to the first pressure, such that the first injection device 14, in particular the fuel distribution element 18, can be supplied with the first pressure or fourth pressure by means of the high-pressure fuel pump 10.

It can be seen from FIG. 8 that the high-pressure fuel pump 10 comprises a high-pressure port 58 (not illustrated in FIG. 1) via which the fuel compressed or pressurized by means of the piston 44 can be fed from the compression chamber 52 to the first injection device 14, in particular to the fuel distribution element 18. This means that the first injection device 14, in particular the fuel distribution element 18, is fluidically connected to the high-pressure fuel pump 10 via the high-pressure port 58. Here, the fuel flows through the high-pressure port 58 at the fourth pressure. In other words, the fuel in the high-pressure port 58 is at the fourth pressure, which is significantly higher than the second and the third pressure.

FIG. 1 shows a dotted line which is used to illustrate a possible first flow of at least a part of the fuel flowing through the duct 32, and thus through the first low-pressure port 30, from the first low-pressure port 30 to the second low-pressure port 36. During the course of this first flow, the fuel flows at least substantially directly from the first low-pressure port 30 to the second low-pressure port 36 and through the latter, or through the second duct 38. Here, said first flow circumvents the pump housing 42. In other words, the first flow does not flow through the pump housing 42.

From the dotted line, it can be seen that at least a part of the fuel flowing into the low-pressure chamber 40 via the inflow can flow out of the low-pressure chamber 40 again and flow to the second low-pressure port 36 and can flow, or be conducted, via the second low-pressure port 36 away from the high-pressure fuel pump 10 to the second injection device 20. The flow of the fuel through the second low-pressure port 36 to the second injection device 20 is illustrated in FIG. 1 by a directional arrow 60.

Since each combustion chamber is assigned an injection valve 22 of the second injection device 20, multiple locations arranged upstream of the combustion chambers are provided at which fuel is injected by means of the second injection device 20. This type of induction pipe injection is also referred to as multi-port injection (MPI), such that the second low-pressure port 36 is also referred to as MPI port.

Here, it is for example possible for at least one of the injection devices 14 and 20, in particular the first injection device 14, to be activated and deactivated according to demand. In the activated state of the injection device 14, the fuel is injected by means of the injection device 14 directly into the combustion chambers. In the deactivated state of the injection device 14, a direct injection of the fuel into the combustion chambers effected by means of the injection device 14 is omitted. Here, even in the deactivated state of the injection device 14, the fuel that is at the third pressure or second pressure, which is lower than the fourth pressure or first pressure, is fed to the high-pressure fuel pump 10 via the inflow. Since the fuel flowing through the inflow is not compressed by means of the high-pressure fuel pump 10 or has not yet been compressed by means of the high-pressure fuel pump 10, the fuel flowing through the inflow is at a low temperature, such that the high-pressure fuel pump 10 is for example cooled by means of the fuel fed to the high-pressure fuel pump 10 via the inflow even when the injection device 14 is deactivated. For this purpose, the fuel flows through the high-pressure fuel pump 10, whereby the latter is cooled.

On a side of the piston 44 averted from the compression chamber 52, a chamber 62 is provided which functions for example as a collecting chamber. The piston 44 is guided for example by means of a guide that is not shown in FIG. 1. Owing to leakages, fuel can flow out of the compression chamber 52 between the piston and the guide, wherein said fuel is also referred to as leakage fuel. The leakage fuel flows into the chamber 62 and is thus collected by means of the chamber 62. It is preferably provided here that the chamber 62 is fluidically connected to the low-pressure chamber 40 by means of at least one connecting duct. The chamber 62 has a volume which is variable by movement of the piston 44 relative to the pump housing 42. If the piston 44 is moved away from the cover 54 in particular by means of the spring element, whereby the volume of the compression chamber 52 is increased, the volume of the chamber 62 is decreased as a result. As a result, for example, fuel that is accommodated in the chamber 62 is conveyed out of the chamber 62 and is conveyed in particular via the stated fluidic connection into the low-pressure chamber 40.

If the piston 44 is moved in the direction of the cover 54 in particular by means of the cam 56, whereby the volume of the compression chamber 52 is decreased, the volume of the chamber 62 is increased. As a result, for example, fuel is drawn from the low-pressure chamber 40 into the chamber 62 via the stated fluidic connection. As already described above, at least a part of the fuel fed to the high-pressure fuel pump 10 via the inflow can flow into the low-pressure chamber 40, because the inflow, in particular the first duct 32, is fluidically connected to the low-pressure chamber 40.

Fuel is thus conveyed back and forth between the chamber 62 and the low-pressure chamber 40 by movement of the piston 44.

As a result of fuel being drawn into the compression chamber 52 and/or into the chamber 62 and the fuel being conveyed out of the compression chamber 52 and/or out of the chamber 62, pulsations of the fuel can arise. It is conceivable here for a damping device to be arranged at least partially in the cover 54, by means of which damping device the stated pulsations of the fuel can be dampened. The cover 54 is thus for example also referred to as damper cover.

It is self-evidently also conceivable for the inflow and the MPI port to be interchanged, such that for example the low-pressure port 36 is formed as inflow and the low-pressure port 30 is formed as MPI port, such that then, for example, the flow direction of the fuel illustrated by the directional arrows 34 and 60 is reversed.

To now be able to keep the costs of the high-pressure fuel pump 10 and thus of the fuel supply device 12 particularly low overall, both low-pressure ports 30 and 36 are arranged on one of the structural elements. It can be seen from FIG. 1 that, in the first embodiment, it is provided that both low-pressure ports 30 and 36 are arranged on the cover 54. This means that both low-pressure ports 30 and 36 are held on the same structural element, in particular directly. Here, the low-pressure ports 30 and 36, in particular the ducts 32 and 38, are fluidically connected to one another by means of a connecting region 64 which is arranged within one of the structural elements. Via the connecting region 64, the fuel can flow from the duct 32 into the duct 38.

It is possible for the first low-pressure port 30 to be formed in one piece with the cover 54. It is alternatively or additionally possible for the second low-pressure port 36 to be formed in one piece with the cover 54. It is furthermore possible for the first low-pressure port 30 to be formed by a component which is formed separately from the cover 54 and which is arranged, in particular held, on the cover 54. It is alternatively or additionally possible for the second low-pressure port 36 to be formed by a component which is formed separately from the cover 54 and which is arranged, in particular held, on the cover 54. It is furthermore possible for the low-pressure ports 30 and 36 to be formed in one piece with one another. It is furthermore conceivable for the low-pressure ports 30 and 36 to be formed by components which are formed separately from one another and which are at least indirectly, in particular directly, connected to one another.

The low-pressure port 30 can be flowed through by the fuel along a flow direction illustrated by the directional arrow 34. Furthermore, the low-pressure port 36 can be flowed through by the fuel along a second flow direction illustrated by the directional arrow 60, wherein the flow directions may run obliquely, parallel or perpendicularly with respect to one another.

To now realize a particularly advantageous supply of the fuel to the internal combustion engine, it is the case, as can be seen in FIG. 1 on the basis of the dotted line, that at least a part of the fuel flowing through the first low-pressure port 30, in particular the first duct 32, flows from the first low-pressure port 30, in particular from the first duct 32, to the second low-pressure port 36, in particular to the second duct 38, circumventing the collecting chamber (chamber 62), and flows through the second low-pressure port 36, in particular the second duct 38.

It can be seen from FIG. 1 that "circumventing the collecting chamber (chamber 62)" is to be understood to mean that that part of the fuel which circumvents the chamber 62 does not flow through the chamber 62, but the part rather flows at least substantially directly from the first low-pressure port 30 through the low-pressure chamber 40 to the low-pressure port 36, and then onward to the second injection device 20.

In other words, at least one flow of the fuel flowing through the first low-pressure port 30 is provided, wherein said at least one flow flows from the low-pressure port 30 through the low-pressure chamber 40 to the low-pressure port 36, and in the process circumvents, that is to say by-passes, the chamber 62.

In the first embodiment illustrated in FIG. 1, it is provided that at least a predominant part of the fuel flowing through the first duct 32 flows from the first low-pressure port 30 through the low-pressure chamber 40 to the second low-pressure port 36, and in the process circumvents the chamber 62. It is furthermore provided in the first embodiment that both low-pressure ports are arranged on the cover 54.

In the first embodiment, it is furthermore provided that, as can be seen from the directional arrows 34 and 60, the flow directions of the fuel flowing through the ducts 32 and 38 run at least substantially perpendicular to one another, or enclose an angle of at least substantially 90 degrees.

Figure 2:
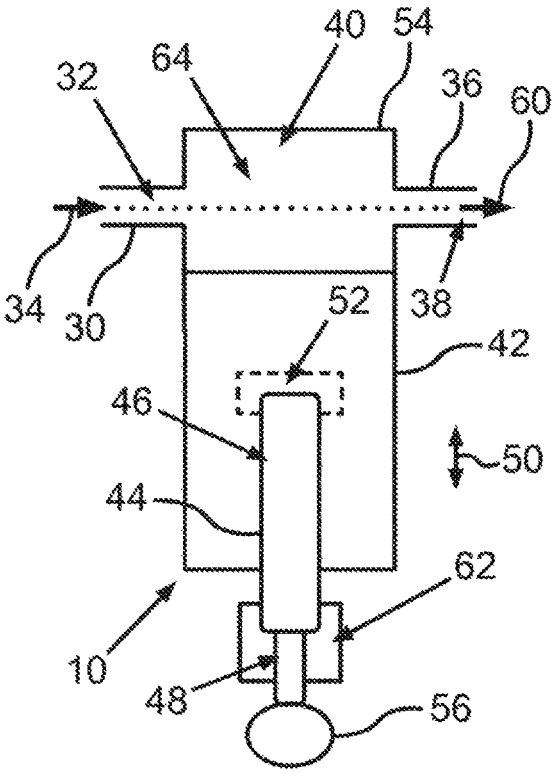
FIG. 2 shows a schematic sectional view of the high-pressure fuel pump according to a second embodiment.

FIG. 2 shows a second embodiment of the high-pressure fuel pump 10. The second embodiment differs from the first embodiment in particular in that the flow directions of the fuel flowing through the ducts 32 and 38 run substantially parallel to one another, and in the present case coincide.

Figure 3:
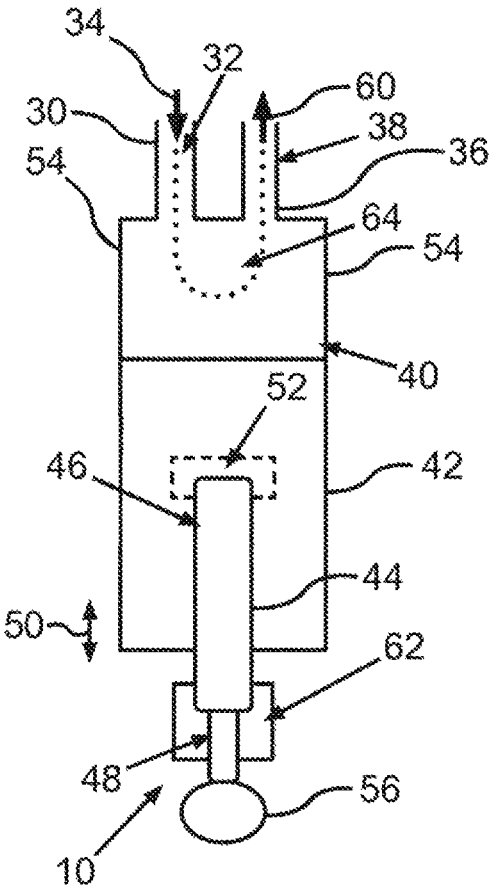
FIG. 3 shows a schematic sectional view of the high-pressure fuel pump according to a third embodiment.

FIG. 3 shows a third embodiment of the high-pressure fuel pump 10. In the second embodiment, the flow directions of the fuel flowing through the ducts 32 and 38 run at least substantially perpendicular to the movement direction of the piston 44, wherein the piston 44 is movable in translational fashion along said movement direction relative to the pump housing 42. By contrast, in the third embodiment, it is provided that the respective flow directions of the fuel flowing through the ducts 32 and 38 run at least substantially parallel to the movement direction of the piston 44, wherein it is also the case in the third embodiment that both low-pressure ports 30 and 36 are arranged on the cover 54.

Figure 4:
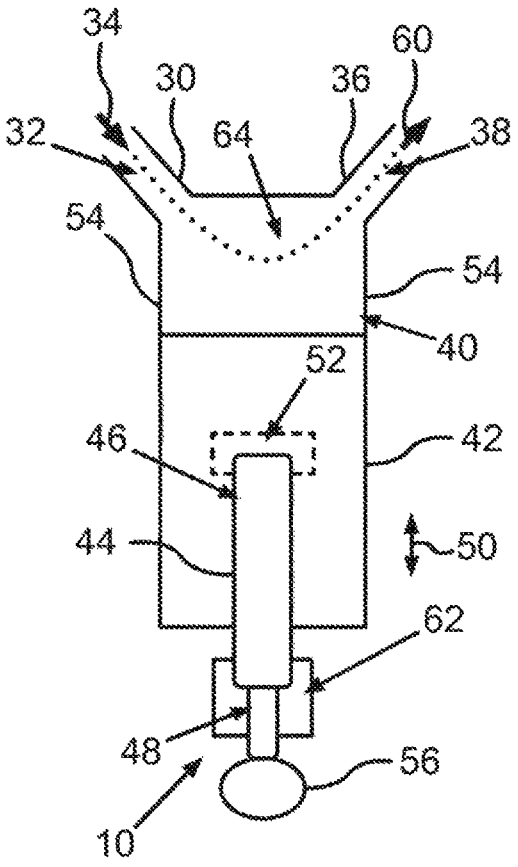
FIG. 4 shows a schematic sectional view of the high-pressure fuel pump according to a fourth embodiment.

FIG. 4 shows a fourth embodiment of the high-pressure fuel pump 10. It is also the case in the fourth embodiment that both low-pressure ports 30 and 36 are arranged on the cover 54. By contrast to the first embodiment, to the second embodiment and to the third embodiment, the flow directions of the fuel flowing through the ducts 32 and 38 run neither perpendicularly nor parallel but rather obliquely with respect to one another. Furthermore, in the high-pressure fuel pump 10, it is provided that the low-pressure ports 30 and 36, that is to say the ducts 32 and 38, are fluidically connected to one another by means of the connecting region 64, wherein the connecting region 64 is arranged in one of the two structural elements, in the present case in the cover 54.

Figure 5:
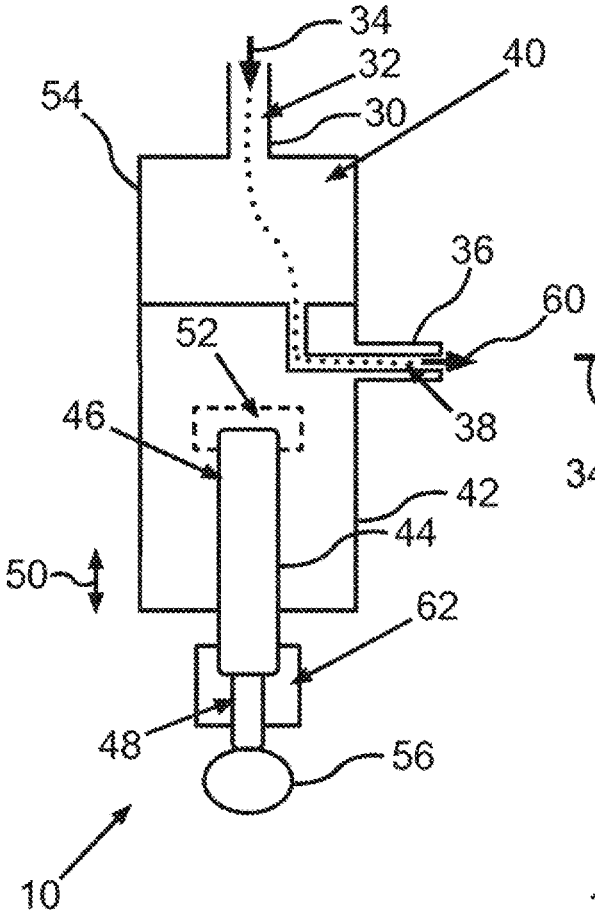
FIG. 5 shows a schematic sectional view of the high-pressure fuel pump according to a fifth embodiment.

FIG. 5 shows a fifth embodiment of the high-pressure fuel pump 10. The fifth embodiment differs from the first, the second, the third and the fourth embodiments in particular in that the first low-pressure port 30 is arranged on a first of the structural elements, and in the present case on the cover 54, wherein the second low-pressure port 36 is arranged on a second of the structural elements, and in the present case on the pump housing 42. It is also provided in the fifth embodiment that at least a part of the fuel flows from the low-pressure port 30 through the low-pressure chamber 40 to the low-pressure port 36, and in the process circumvents the collecting chamber 62.

Figure 6:
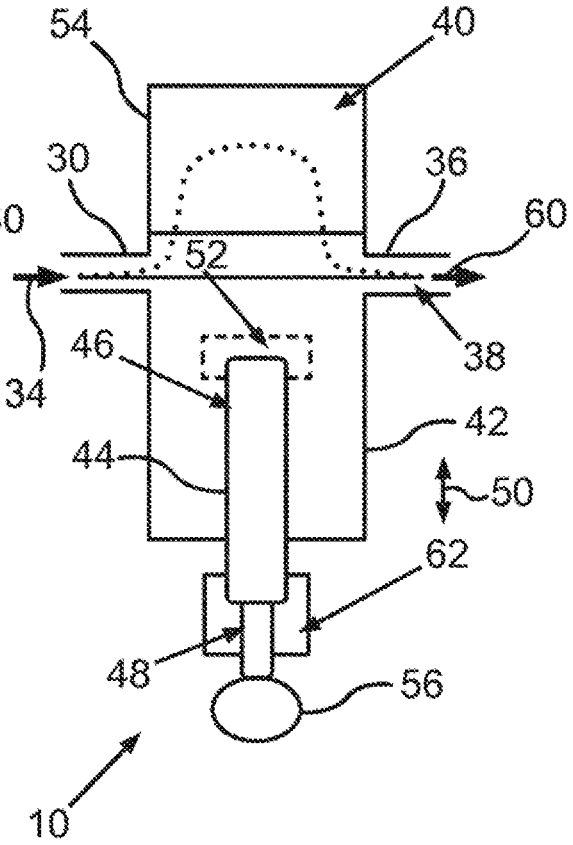
FIG. 6 shows a schematic sectional view of the high-pressure fuel pump according to a sixth embodiment.

FIG. 6 shows a sixth embodiment of the high-pressure fuel pump 10. In the sixth embodiment, a first flow can occur as illustrated by a dotted line. It can be seen from FIG. 6 that the first flow runs from the first low-pressure port 30 to the second low-pressure port 36 and in the process circumvents the chamber 62 and runs through the low-pressure chamber 40, which is formed by the cover 54. The connecting region 64 (not shown in FIG. 6) is in this case arranged outside the pump housing 42 and in the cover 54, in particular in the low-pressure chamber 40.

As an alternative to the first flow, a second flow of the fuel may occur as illustrated by a solid line. The second flow flows from the first low-pressure port 30 to the second low-pressure port 36 and in the process circumvents both the low-pressure chamber 40 and the chamber 62, such that the second flow flows at least substantially directly, circumventing both the low-pressure chamber 40 and the chamber 62, from the low-pressure port 30 to the low-pressure port 36. Here, the connecting region 64 is arranged for example in the pump housing 42 and outside the cover 54.

Figure 7:
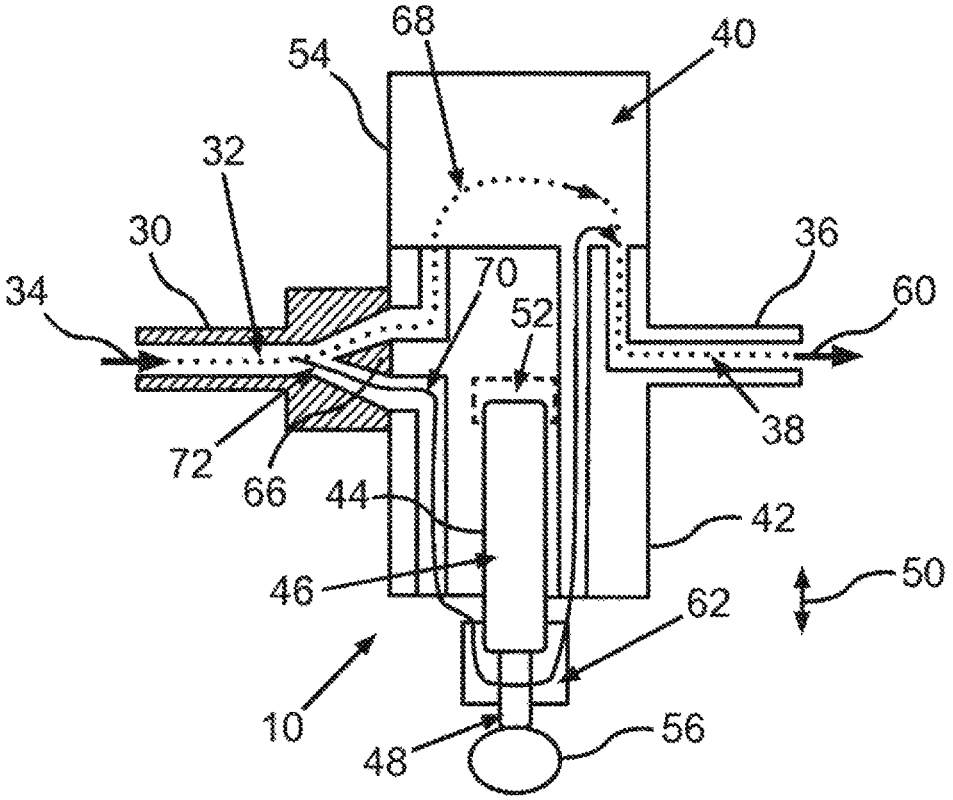
FIG. 7 shows a schematic sectional view of the high-pressure fuel pump according to a seventh embodiment.

Finally, FIG. 7 shows a seventh embodiment of the high-pressure fuel pump 10. In the seventh embodiment, at least one flow-dividing element 66 is provided, by means of which the fuel flowing through the first low-pressure port 30, in particular the first duct 32, can be or is divided into a first partial stream 68 and a second partial stream 70. Furthermore, in the seventh embodiment, it is provided that the first low-pressure port 30 is formed by a component which is formed separately from the structural elements and which in the present case is arranged on the pump housing 42. Here, the first partial stream 68 flows from the first low-pressure port 30 through the low-pressure chamber 40 to the second low-pressure port 36, circumventing the chamber 62, and flows through the second low-pressure port 36. By contrast, the second partial stream 70 flows from the first low-pressure port 30 to the chamber 62, through the collecting chamber 62, subsequently through the low-pressure chamber 40, and finally to the second low-pressure port 36 and through the latter.

It may be provided here that the partial streams 68 and 70, which are separated from one another by means of the flow-dividing element 66 upstream of or outside the low-pressure chamber 40, mix in the low-pressure chamber 40 upstream of the second duct 38. As an alternative to the mixing of the partial streams 68 and 70 that is shown in FIG. 7 and takes place in the low-pressure chamber 40, it may be provided that the partial streams 68 and 70 mix for example in the pump housing 42, in particular directly upstream of the MPI port.

Here, the flow-dividing element 66 is arranged outside the structural elements and is designed to divide the fuel into the partial streams 68 and 70 at at least one location 72 arranged outside the structural elements. This means that the fuel is divided into the partial streams 68 and 70 by means of the flow-dividing element 66 at the location 72 arranged outside the structural elements. The division of the fuel into the partial streams 68 and 70 thus takes place already upstream of the structural elements, and in particular upstream of the pump housing 42, that is to say before the fuel flows into the pump housing 42 and the cover 54. The separation of the fuel into the partial streams 68 and 70, which are for example in the form of volume flows, thus takes place not in the pump housing 42 but outside the latter, wherein the separation of the fuel into the partial streams 68 and 70 takes place in the present case in the first low-pressure port 30, or in the component that forms the first low-pressure port 30.

The invention claimed is:

1. A high-pressure fuel pump for supplying fuel to a first injection device of an internal combustion engine of a motor vehicle, the high-pressure fuel pump comprising:

at least one first low-pressure port, via which the fuel is fed to the high-pressure fuel pump from a low-pressure fuel pump;

at least one low-pressure chamber, to which at least a part of the fuel fed to the high-pressure fuel pump via the first low-pressure port is fed;

at least one second low-pressure port, for conducting the fuel away from the high-pressure fuel pump to a second injection device provided in addition to the first injection device;

a pump housing, in which there is arranged at least one conveying element which is movable relative to the pump housing and which serves for conveying the fuel to the first injection device, and on which the at least one second low-pressure port is arranged;

a compression chamber, the volume of which is variable by movement of a respective one of the at least one conveying element;

a collecting chamber, which is arranged on a side of the respective one of the at least one conveying element averted from the compression chamber and which is variable in terms of volume by movement of the respective one of the at least one conveying element and which serves for collecting fuel from the compression chamber, and the collecting chamber is fluidically connected to the at least one low-pressure chamber;

a second structural element formed separately from the pump housing and held on the pump housing;

a connecting region arranged within one of the pump housing or the second structural element, such that the at least one first low-pressure port and the at least one second low-pressure port are fluidically connected to one another by the connecting region; and at least one flow-dividing element which divides the fuel flowing through the at least one first low-pressure port into a first partial stream and a second partial stream at a location upstream of the pump housing, and on which the at least one first low-pressure port is arranged;

wherein the first partial stream flows from the at least one first low-pressure port to the at least one second low-pressure port, circumventing the collecting chamber, and flows through the at least one second low-pressure port, and the second partial stream flows from the at least one first low-pressure port into the collecting chamber, through the collecting chamber and subsequently to the at least one second low-pressure port, and flows through the at least one second low-pressure port.

2. The high-pressure fuel pump as claimed in claim 1, wherein the at least one flow-dividing element is arranged outside the pump housing and the second structural element and is designed to divide the fuel into the first partial stream and the second partial stream in at least one location arranged outside the pump housing and the second structural element.

3. The high-pressure fuel pump as claimed in claim 2, wherein the at least one second low-pressure port is formed in one piece with one of the pump housing or the second structural element.

4. The high-pressure fuel pump as claimed in claim 2, wherein the at least one first low-pressure port and/or the at least one second low-pressure port is formed by a component which is formed separately from one of the pump housing or the second structural element and which is arranged on one of the pump housing or the second structural element.

5. The high-pressure fuel pump as claimed in claim 2, wherein the at least one first low-pressure port and the at least one second low-pressure port are formed by components which are formed separately from one another and which are at least indirectly connected to one another.

6. The high-pressure fuel pump as claimed in claim 5, further comprising:

a plurality of flow directions, the at least one first low-pressure and the at least one second low-pressure port are flowed through by the fuel along one of the plurality of flow directions;

wherein the plurality of flow directions run parallel to or obliquely with respect to one another.

* * * * *